US006178783B1

(12) United States Patent
Lin

(10) Patent No.: US 6,178,783 B1
(45) Date of Patent: Jan. 30, 2001

(54) YARN FEEDER FOR KNITTING MACHINE

(76) Inventor: Chung-Min Lin, No.4, Aly.122, Ln.352, Sec.1, ChungShan Rd.,YungHo, Taipei (TW)

( * ) Notice: Under 35 U.S.C. 154(b), the term of this patent shall be extended for 0 days.

(21) Appl. No.: 09/522,364

(22) Filed: Mar. 9, 2000

(51) Int. Cl.[7] ..... D04B 15/48
(52) U.S. Cl. ..... 66/132 T; 66/132 R; 242/366
(58) Field of Search ..... 66/132 R, 132 T, 66/146, 125 R; 242/151, 152, 366

(56) References Cited

U.S. PATENT DOCUMENTS 3,955,769 * 5/1976 Kajiura et al. ..... 66/132
4,114,823 * 9/1978 Fecker et al. ..... 66/132
4,754,936 * 7/1988 Guell et al. ..... 66/132
5,802,879 * 6/1998 Min ..... 66/132
5,802,880 * 9/1998 Min ..... 66/132
5,802,881 * 9/1998 Lin ..... 66/132
5,839,685 * 11/1998 Chen ..... 66/132 T

* cited by examiner

*Primary Examiner*—Danny Worrell
(74) *Attorney, Agent, or Firm*—Dougherty & Troxell

(57) ABSTRACT

An improved yarn feeder for knitting machines includes a frame, a feeding reel, a brake, a press block, a pulley, a holder, a transmission spindle and a yarn guide. The feeding reel includes a driven wheel which has a top flange with a center opening and a plurality of equally spaced rods extending downward from bottom surface of the top flange, and a driving wheel which has spoke like ribs each has a slot opening at a free end thereof for engaging with an elongated bar at a lower portion which has a "8" shaped crosssection. The driving wheel may engage with the driven wheel through the center opening with the top end of the elongated bar engaged with a cavity formed in the bottom side of the top flange between a pair of adjacent rods. The feeding reel and the yarn feeder may be made with greater precision at a lower cost than conventional yarn feeder.

11 Claims, 6 Drawing Sheets

YARN FEEDER FOR KNITTING MACHINE

FIELD OF THE INVENTION

This invention relates to an improved yarn feeder for a knitting machine and particularly to an improved yarn feeder that is simple to fabricate and assemble and has a lower cost with enhanced feeding reel precision.

BACKGROUND OF THE INVENTION

A Conventional yarn feeder for knitting machines such as the one shown in FIGS. 1 and 2 usually includes a frame A, a feeding reel B, a brake C, a pulley D, a holder E, a transmission spindle F and a yarn guide G. The feeding reel B is located below the frame A and held by the holder E and driven by the transmission spindle F which passes through the frame A to engage with the pulley D located above the frame A. The rotating pulley D drives the yarn reel B to rotate for pulling yarn I from a yarn pool H. The yarn I leaves the yarns pool H, passes through a guide bracket J, a filter K, a press disk L, below an upper brake lever M, a first porcelain eye N, winds a number of times around the yarn reel B, then passes through above a porcelain bar of the yarn guide G, below a lower brake lever O, a second porcelain eye Q and reaches a knitting needle for knitting process. The yarn reel B provides a stable tension yarn for producing high quality fabric. The yarn reel B includes a driving wheel S engaged with a driven wheel T which has a spindle opening U engaged with a bearing R which in turn engages with the holder E and mounted below the frame A. The yarn reel B thus is able to turn freely about the bearing R.

The driven wheel T has a plurality of equally spaced rods V extending downward. Below the driven wheel and between a pair of adjacent rods V, a cavity bore W is formed. The driving wheel S has a center spindle bore X enageable with one end of the spindle F and a plurality of elongated bars Y engaged with the cavity bores W when assembled with the driven wheel T. The yarn reel B has a taper angle from the top of the driven wheel T to the bottom of the driving wheel S so that yarn I wound around the yarn reel B may slip downward during the knitting process to make yarn feeding smooth and steady. As the driving wheel T and the rods V are usually made by injection molding plastics, the precision of the rods V is often less than desired. When in use, one end of the rod V engages with the driving wheel S which may increase dimensional distortion of the elongated bars Y. The dimensional accuracy of the yarn reel B after assembly thus may be further downgraded.

The holder E is made of metal and has an inclined top surface mounted on the frame A through a washer (not shown). It takes a lot of machining work to attain the precision required. The machining of the spindle F is equally demanding and time consuming. All this increases production time and cost.

Furthermore the press disk L uses a spring force to give yarn a tension. It does not finction well for thin or smooth yarns and may result in yarn dropping from the yarn reel B which affects the knitting machine operation. All of aforesaid problems and disadvantages are still begging for improvement.

SUMMARY OF THE INVENTION

It is an object of this invention to provide an improved yarn feeder for knitting machines that has an improved feeding reel which may be made with high-precision at low cost and has smooth profile for avoiding yarn jam or breakage. The feeding reel of this invention has a driving wheel with a plurality of spoke like ribs. Each rib has a slot opening at the free end engageable with an elongated bar. The feeding reel further has a driven wheel with a trough formed in a top wall for the driving wheel to pass through so that the driving wheel and the driven wheel may form together a strong and highly accurate assembly with a smooth profile for the yarn to wind around and move smoothly thereon during the knitting process.

It is another object of this invention to provide a feeding reel holder made of injection molded plastics which may be made at low cost and has desired slope and dimension to mount the driven wheel on the frame precisely without causing yarn jam.

It is a further object of this invention to provide an improved yarn feeder that has a two head bushing engageable with the pulley and the spindle so that the driving wheel may engage easily and securely with the pulley. The spindle has an uniform diameter and thus may be produced at a lower cost.

It is yet another object of this invention to provide an improved yarn feeder that has an improved press block which includes magnetic yarn press barrels for pressing yarn at steady and desired pressure and a knife slot for removing yarn debris.

It is still another object of this invention to provide an improved yarn feeder that has movable blocks in the driven wheel for holding yarn debris so that higher quality of fabric may be produced and yarn debris may be collected and removed by operator easily.

BRIEF DESCRIPTION OF THE DRAWINGS

The invention, as well as its many advantages, may be further understood by the following detailed description and drawings in which.

DETAILED DESCRIPTION OF THE PREFERRED EMBODIMENT

Figures 3, 3A, 3B:
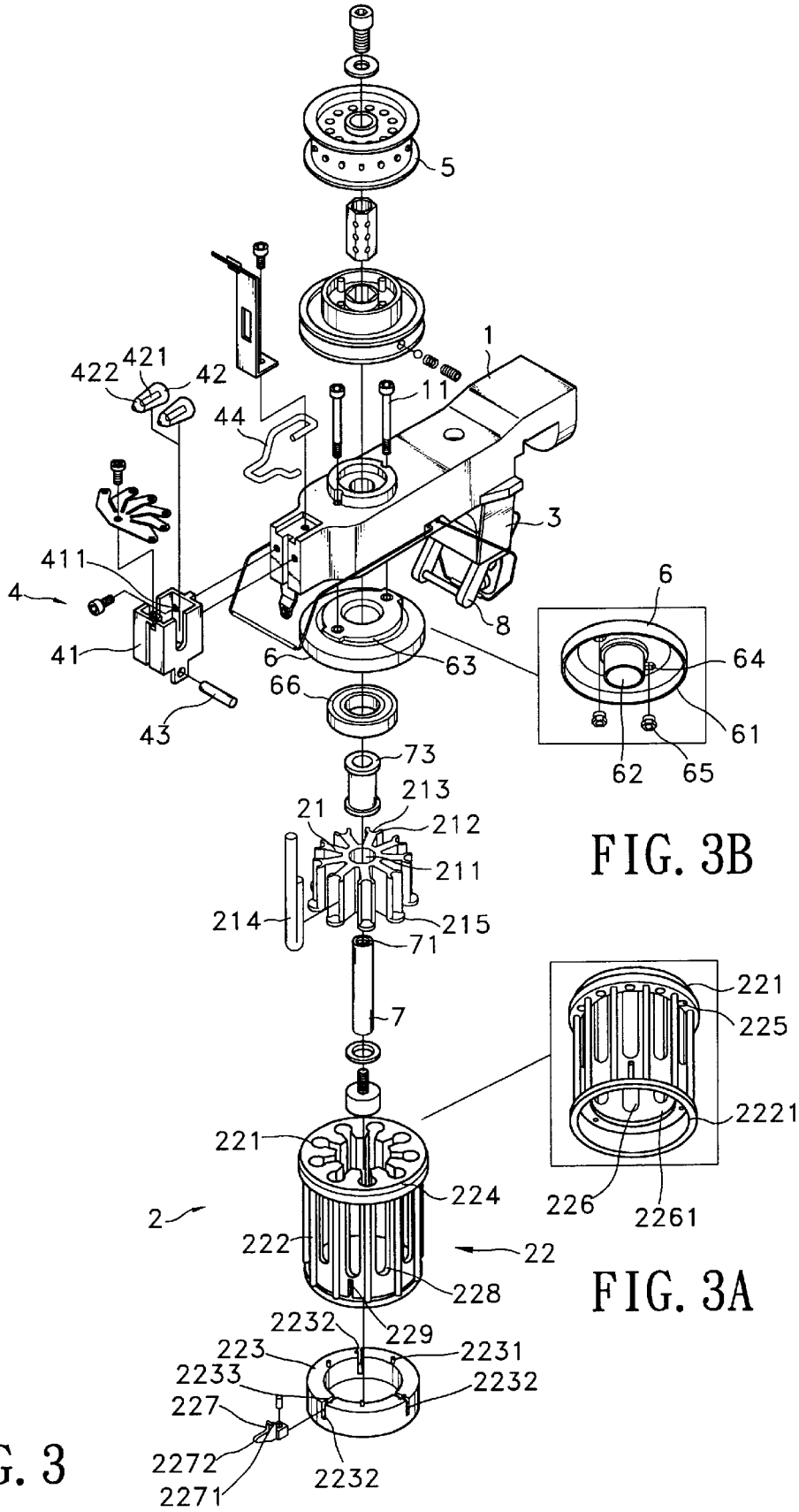
FIG. 3 is an exploded view of this invention.
FIG. 3A is a perspective view of a driven wheel of this invention.
FIG. 3B is a perspective view of a holder of this invention.
Figure 4:
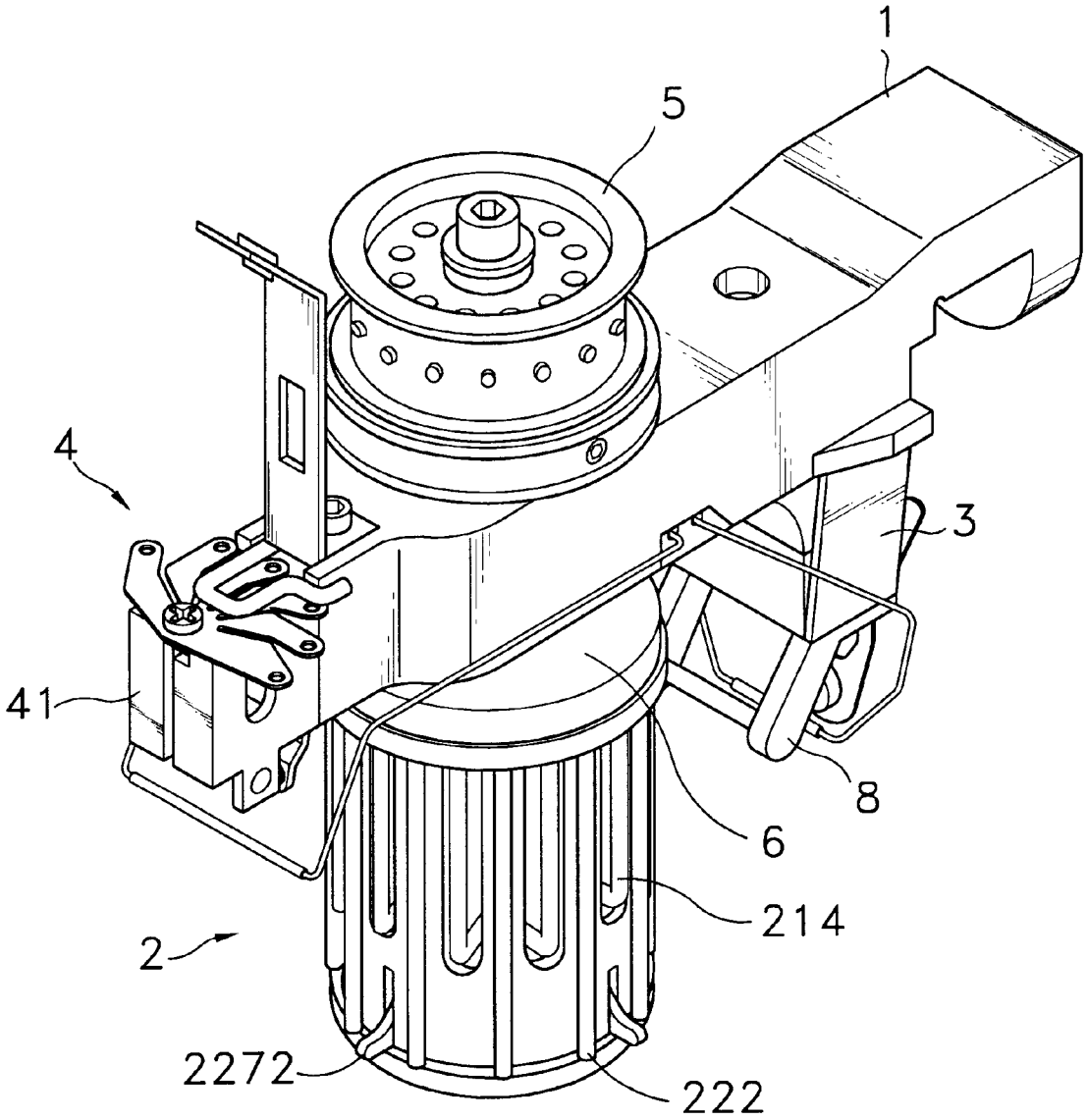
FIG. 4 is a perspective view of this invention after assembly.

Referring to FIGS. 3 and 4, the yarn feeder of this invention includes a frame 1, a feeding reel 2, a brake 3, a press block 4, a pulley 5, a holder 6, a transmission spindle 7 and a yarn guide 8. The press block 4 is located at a front end of the frame 1. The pulley 5 and feeding reel 2 are respectively mounted above and below the frame 1 by means of the holder 6 and driven by the spindle 7. The pulley 5 may be rotated by a belt (not shown in the figures) to drive the spindle 7 and the feeding reel 2 to rotate synchronously.

The feeding reel 2 includes a driving wheel 21 engaged with a driven wheel 22 through a trough 221 formed in the top flange 224 thereof. There are a plurality of equally spaced rods 222 formed vertically below the top flange 224 with a cavity 225 formed between each pair of adjacent rods 222. At the outer rim of the driven wheel, there is also a through hole 228 formed between a pair of adjacent rods 222.

The driving wheel 21 has a center spindle hole 211 and spoke-like ribs 212. Each rib has a free end formed with a slot opening 213 engageable with a shorter portion of an elongated bar 214. The elongated bar 214 has a longer portion connected with the shorter portion to form a "8" shape crosssection. When the driving wheel 21 engages with the driven wheel 22 through the trough 221, the longer portion of the elongated bar 214 passes through the through hole 228 and has its top end engaging with the cavity 225 (also shown in FIG. 3A). Such structure makes assembly of the feeding reel 2 fast and more precise. Then the driven wheel 22 may be mounted on the holder 6 and the driving wheel 21 may be engaged with the spindle 7.

The driven wheel 22 and the rods 222 can be made as a piece by integrated molding plastics, insert molding, or any method as the like. The trough 221 can also hold a bearing 66 located in the holder 6. The lower end 221 of the rod 222 has a smaller diameter than the upper end thereof. The bottom rim of the driven wheel 22 has a smaller diameter than the gross diameter of the circumference formed by the rods 222.

The bottom end of each rib 212 has a curved flange 215 which is smaller than the cross-section of the elongated bar 214. Hence when the elongated bar 214 engages with the rib 212, the flange 215 is withdrawn from the outside surface of the bar 214. Yarn 9 thus may be wound around the feeding reel 2 outside the bars 214 and slips downward for feeding the knitting machine without getting caught or broken.

Figure 5:
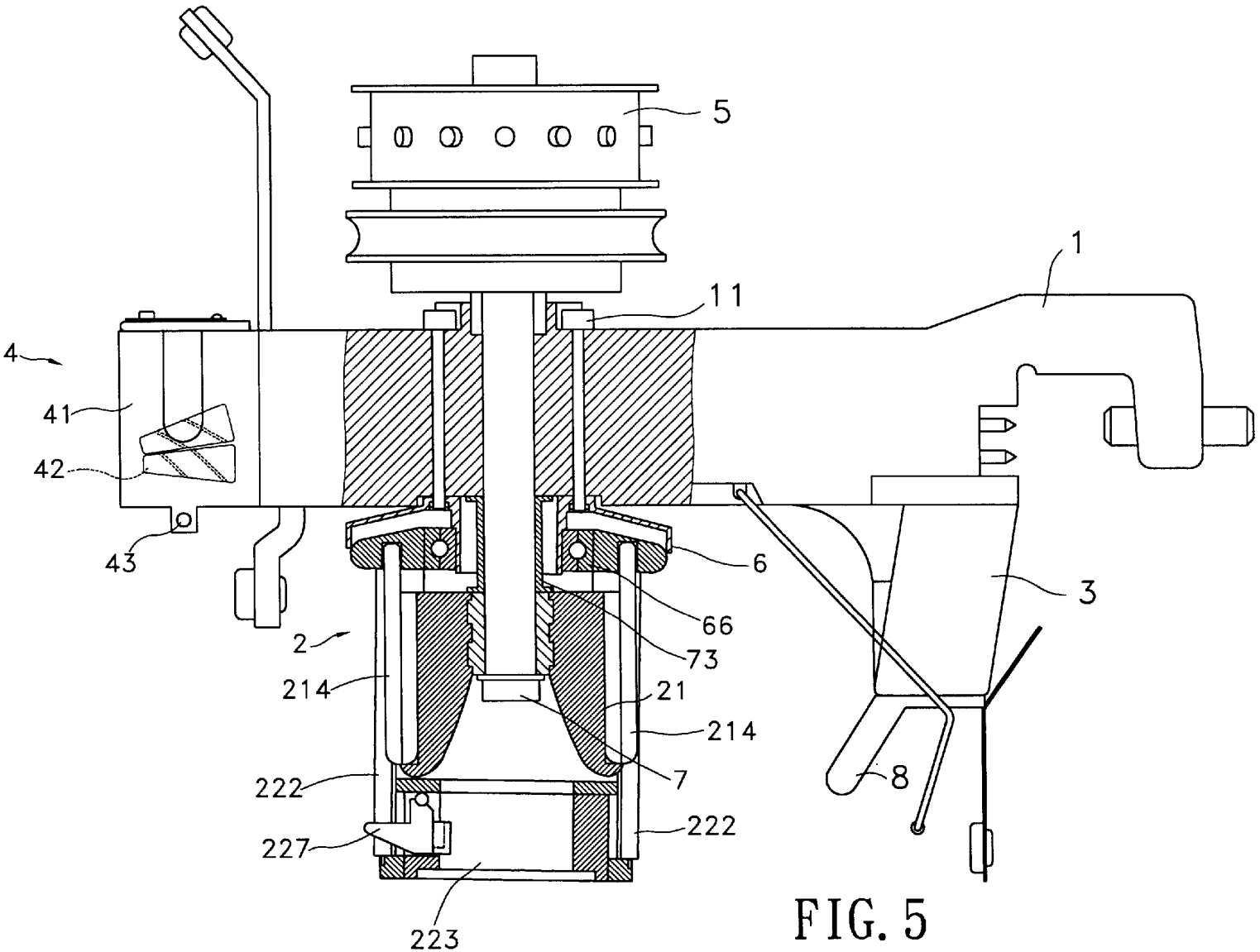
FIG. 5 is a sectional view of this invention.

Referring to FIG. 3B, the holder 6 is also made of injection molding plastics having a top cap 61 for covering the top end of the driven wheel 22 and a sleeve 62 formed in the center. Above the top cap 61, there is a sloped step ring 63. In the bottom side of the top cap 61 under the step ring 63, there are hexagon cavities 64 to enable the holder 6 be fastened to the frame 1 by means of hexagon nuts 65 and bolts 11. The inner ring of the bearing 66 engages with the sleeve 62 while the outer ring of the bearing 66 engages with the driven wheel 22 (also shown in FIG. 5). Once the holder 6 holds the feeding reel 2 on the frame 1, the driven wheel 22 may be rotated freely about the bearing 66. The top cap 61 may also prevent from yarn 9 from dropping into the feeding reel 2 to cause malfunction of the knitting machine. As the holder 6 is made of injection molding plastics, it needs no additional machining work and may be made with less cost.

Figure 1:
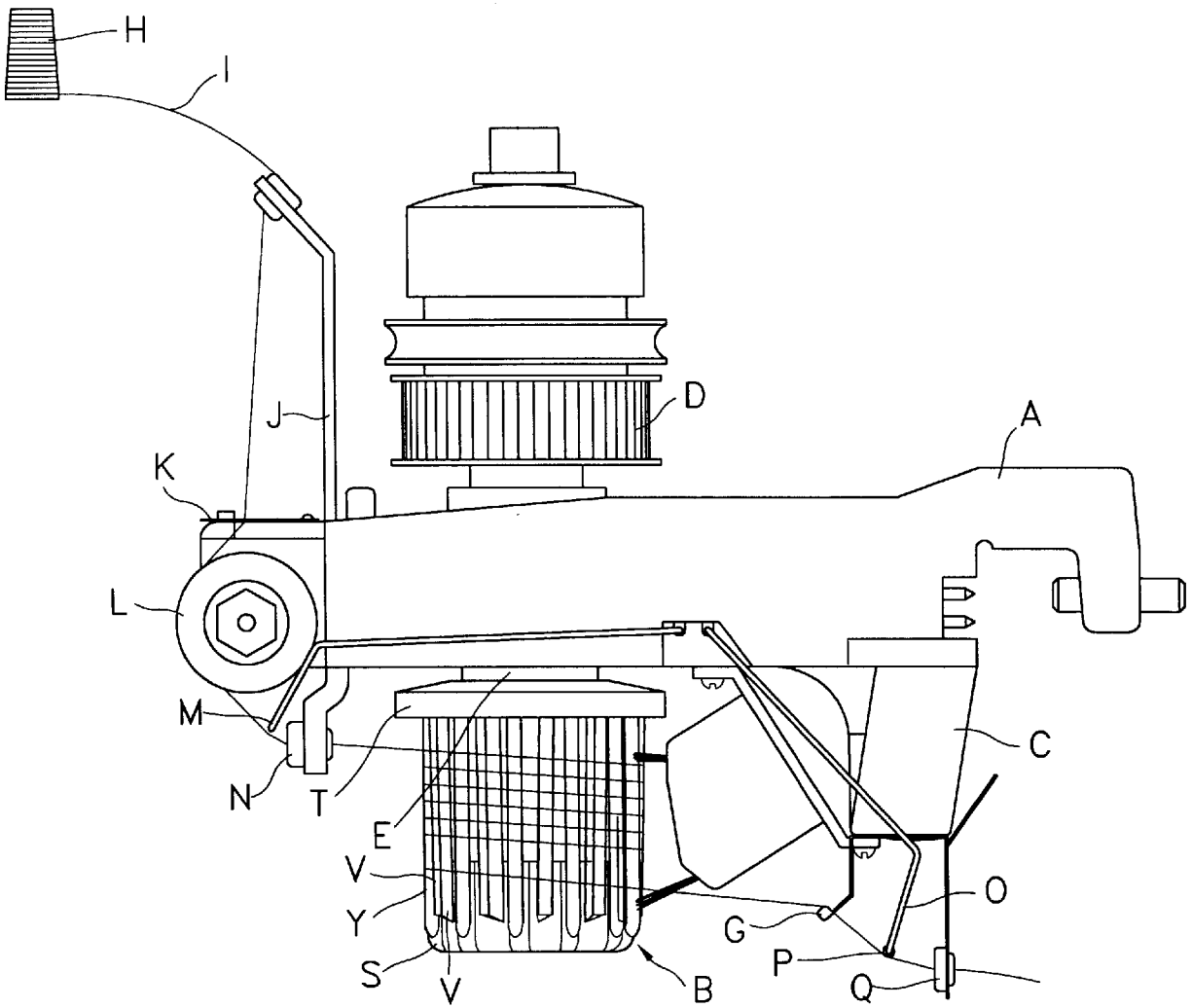
FIG. 1 (PRIOR ART)
FIG. 1 is a side view of a conventional yarn feeder.
Figure 2:
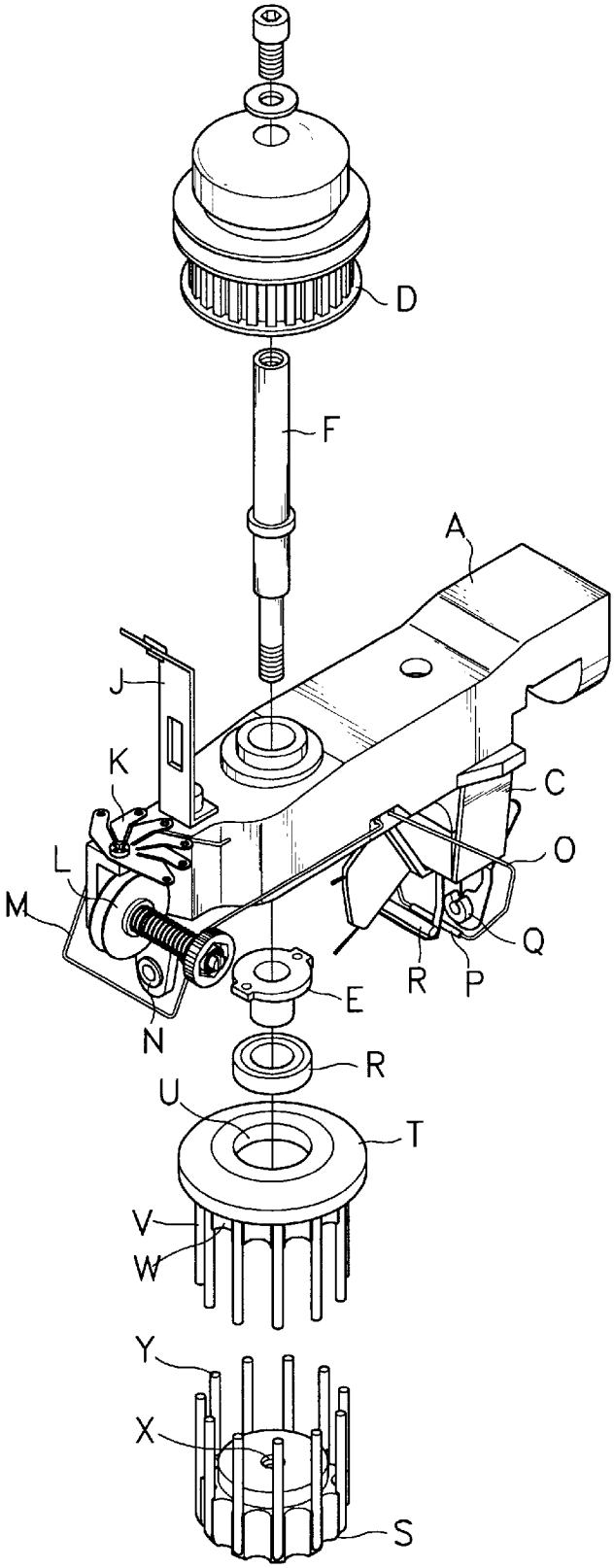
FIG. 2 (PRIOR ART)
FIG. 2 is an exploded view of a conventional yarn feeder.

The spindle 7 may be made with uniform diameter beyond the bottom end and with an internal screw hole 71 at the top end. A two-head bushing 73 may be used to house the spindle 7 for engaging the driving wheel 21 with the pulley 5. The engaging flange needed on the conventional spindle (shown in FIG. 2) thus may be dispensed with. The production and machining time and cost of the spindle thus may be reduced.

Figure 6:
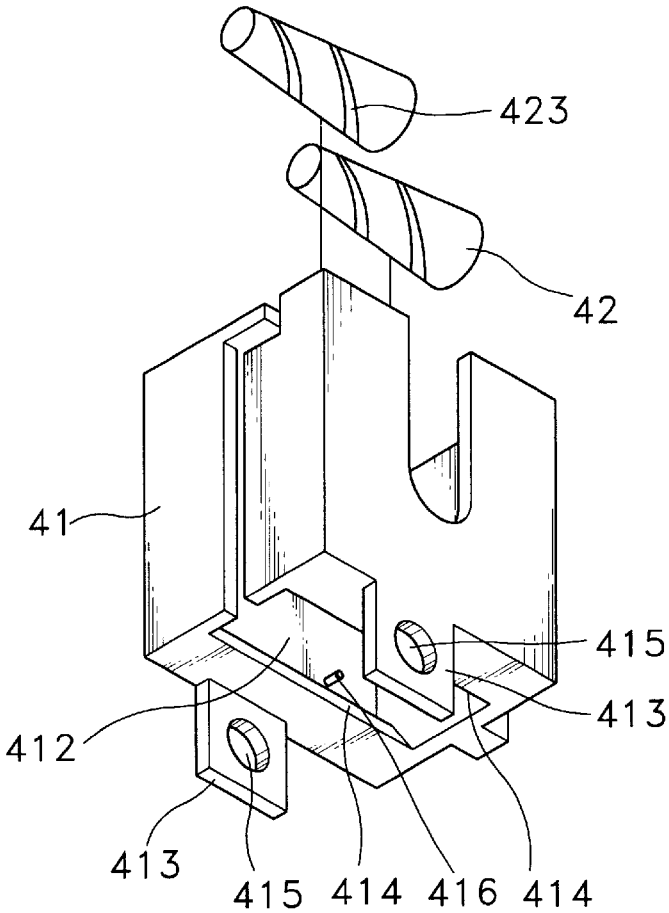
FIG. 6 is a perspective view of a bracket for a press block.

In this invention, the press block 4 includes a bracket 41, a pair of press barrels 42 and a porcelain bar 43. The bracket 41 has an aperture 411 in a side wall for fastening the bracket 41 to the frame 1 and a slot opening 412 formed in a bottom wall. At the left and right side of the slot opening 412, there are a pair of porcelain bar holders 413 (shown in FIG. 6) which have respectively an opening 415 for holding the porcelain bar 43. The press barrel 42 has a conical surface 422 and has a magnet located therein. The press barrels 42 are located in the bracket 41 and are held there securely by a yarn hook 44. Because of magnetic force, the press barrels 42 are attracted and make contact with each other. Yarn 9 may enter between the press barrels 42 from the conical surface 422 and will be pressed under the constant magnetic force regardless of the yarn nature or size. In the slot opening 412, there is a knift slot 414 for removing yarn debris attached to the yarn 8. The two contact press barrels 42 are rotating at opposite direction and may shake down yarn debris automatically during rotation.

Figure 7:
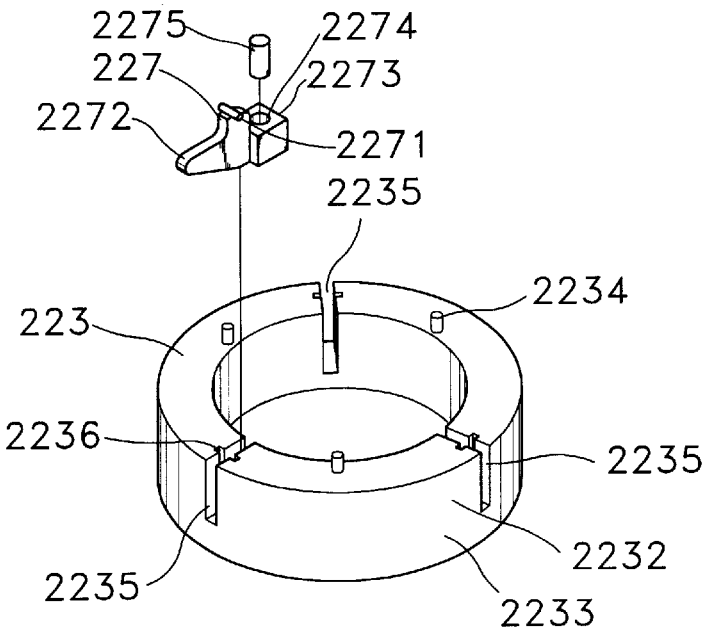
FIG. 7 is a perspective view of a movable block and an inner ring of a driven wheel of this invention.

Referring to FIGS. 3A and 7, at the inside lower portion of the driven wheel 22, there is provided with an annular ring 226 which has cavities 226 formed therein. An inner ring 223 may be attached to the driven wheel 22 from below by means of stubs 2231 formed on the top rim thereof engaging with the cavities 2261. The inner ring 223 has a plurality of slots 2232. Each slot 2232 has a pair of opposite troughs 2233. A movable block 227 which has two opposite lugs 2271 may be movably held in the slot 2232 by wedging the lugs 2271 in the troughs 2233. The movable block 227 has a front tip 2272 extending outside the inner ring 223 and a groove 229 formed in the driven wheel 22 at a position mating against the trough 2232. The movable block further has a butt 2273 in a rear side. The butt 2273 has a cavity 2274 for holding a balance weight 2275 so that the movable block 227 may always be held in the trough 2232 with the front tip 2272 extending outward. By means of such structure, yarn debris falling along the rods 222 will be stopped and held by the movable block 227 without going to the fabric so that higher quality fabric may be produced. The front tip 2272 enables operator to move up the movable block 227 from time to time for removing the accumulated yarn debris.

In summary, this invention may enable the feeding reel of the yarn feeder be produced with more precision at a lower cost, and may also result in producing higher quality of fabric.

It may thus be seen that the objects of the present invention set forth herein, as well as those made apparent from the foregoing description, are efficiently attained. While the preferred embodiment of the invention have been set forth for purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A yarn feeder for knitting machines, comprising a frame, a brake, a press block, a yarn guide, a feeding reel located below the frame including a driven wheel which has a top flange having a center opening, a plurality of equally spaced rods extending downward from the top flange, a cavity formed in a bottom side of the top flange between each pair of spaced rods and a through hole formed in the driven wheel between a pair of rods, and a driving wheel engaged with the driven wheel through the center opening having a center spindle hole and a plurality of spoke shaped ribs, each rib has a slot opening formed at a free end thereof engageable with a lower portion of an elongated bar, the elongated bar passing through the through hole and having a top end thereof engaging with the cavity of the driven wheel;

a holder located below the frame for holding the feeding reel to the frame;

a transmission spindle engaged with the spindle hole of the driving wheel, running through the holder and having a top end extended above the frame; and a pulley engaged with the top end of the transmission spindle and driven by a belt for rotating the feeding reel.

2. The yarn feeder of claim 1, wherein each rib has a flange at a bottom end thereof for supporting the elongated bar without a gap therebetween so that a yarn wound around the feeding reel won't be caught.

3. The yarn feeder of claim 1, wherein the holder has a sloped top cap engaged with the driven wheel, a step ring above the top cap with a plurality of screw cavities formed therein for the holder to be fastened to the frame by means of hexagon nuts and bolts, and a center sleeve for holding a bearing therein to engage with the driven wheel so that the feeding reel may be turned freely.

4. The yarn feeder of claim 1, wherein the holder is integrally made of injection molding plastics.

5. The yarn feeder of claim 1, wherein the transmission spindle has a uniform diameter and is engaged with a two-head bushing for engaging with the feeding reel.

6. The yarn feeder of claim 1, wherein the press block is located at a front end of the frame and includes a bracket, a pair of press barrels and a porcelain bar, the bracket has an aperture in a sidewall for fastening with the frame through a screw, a slot opening in a bottom wall, a pair of spaced porcelain bar holders beside the slot opening and having openings therein for holding the porcelain bar and a knife slot located in the slot opening, the press barrels are held securely in the bracket by a yarn hook and have respectively magnets located therein for the two press barrels to attract and make contact with each other by magnetic force to press a yarn coming through one end of the press block.

7. The yarn feeder of claim 6, wherein the press barrel has conical surface at one end to facilitate threading a yarn between the two press barrels.

8. The yarn feeder of claim 1, wherein the driven wheel and the rods are made as a single piece, the center opening engages a bearing located in the holder, the rods having a diameter at lower portion smaller than a diameter at an upper portion, and the driven wheel has a diameter at a bottom rim smaller than a diameter formed by outside surfaces of the rods.

9. The yarn feeder of claim 1, wherein the driven wheel further has movable blocks located at a lower rim thereof for holding yarn debris and preventing yarn from slipping.

10. The yarn feeder of claim 9, wherein the driven wheel has an annular ring located inside a lower portion thereof, the annular ring having a plurality of ring cavities formed therein, an inner ring having a plurality of stubs located above an upper rim thereof engaged with the ring cavities and a plurality of grooves formed in a lower rim below the annular ring, the inner ring having a plurality of slots mating against the grooves, each slot having two opposite troughs formed therein, the movable blocks having two opposite lugs slidably engaged with the troughs and a front tip extending outside the driven wheel through the slot and groove.

11. The yarn feeder of claim 10, wherein the movable blocks have a rear end which has a cavity for holding a balance weight.

* * * * *